US009296100B2

(12) United States Patent
Descombes et al.

(10) Patent No.: US 9,296,100 B2
(45) Date of Patent: Mar. 29, 2016

(54) HANDLE FOR A HAND-OPERATED STRIKING TOOL, HAND-OPERATED STRIKING TOOL AND METHOD FOR MANUFACTURING A HAND-OPERATED STRIKING TOOL

(71) Applicant: FISKARS FRANCE SAS, Wissous (FR)

(72) Inventors: Frédéric Gilbert Descombes, Saint Hélène du Lac (FR); Chris Thelisson, Bourgoin Jallieu (FR); Serge Gouverneur, Chambery (FR)

(73) Assignee: FISKARS FRANCE SAS, Wissous (FR)

( * ) Notice: Subject to any disclaimer, the term of this patent is extended or adjusted under 35 U.S.C. 154(b) by 252 days.

(21) Appl. No.: 14/170,076

(22) Filed: Jan. 31, 2014

(65) Prior Publication Data

US 2014/0230616 A1 Aug. 21, 2014

(30) Foreign Application Priority Data

Feb. 21, 2013 (FR) ..... 13 00398

(51) Int. Cl.
*B25G 1/01* (2006.01)
*B25G 3/12* (2006.01)
*B25G 3/02* (2006.01)

(52) U.S. Cl.
CPC .. *B25G 1/01* (2013.01); *B25G 3/02* (2013.01); *B25G 3/12* (2013.01); *Y10T 29/49947* (2015.01)

(58) Field of Classification Search
CPC ..... B25G 1/01; B25G 3/02; B25G 3/12; Y10T 29/49947
See application file for complete search history.

(56) References Cited

U.S. PATENT DOCUMENTS

| | | | | | |
|---|---|---|---|---|---|
| 255,166 | A | | 3/1882 | Hardie | |
| 2,204,643 | A | * | 6/1940 | Zeckendorf | B25G 3/02 403/316 |
| 3,819,288 | A | * | 6/1974 | Carmien | B25G 3/02 403/247 |
| 4,030,847 | A | * | 6/1977 | Carmien | B25G 3/06 403/263 |
| 4,085,784 | A | * | 4/1978 | Fish | B25G 3/14 81/20 |
| 4,188,703 | A | * | 2/1980 | Fish | B25G 3/02 29/460 |
| 4,516,615 | A | * | 5/1985 | Finn | B25G 3/14 403/266 |
| 5,056,381 | A | | 10/1991 | Carmein | |
| 6,619,408 | B1 | * | 9/2003 | Lai | B25G 1/01 16/110.1 |
| 2012/0152066 | A1 | | 6/2012 | Descombes et al. | |

FOREIGN PATENT DOCUMENTS

| | | | |
|---|---|---|---|
| FR | 2 873 053 | A1 | 1/2006 |
| WO | WO 97/10075 | A1 | 3/1997 |

* cited by examiner

*Primary Examiner* — David B Thomas
(74) *Attorney, Agent, or Firm* — Oliff PLC

(57) ABSTRACT

The invention relates to a handle for a hand-operated striking tool including a body having a striking end corresponding to a terminal area. The handle also includes a connection system configured to surround the terminal area of the body at a distance so as to define a space between the connection system and body. The connection system includes at least one access hole to the body on each front surface in the terminal area of the body. At least two securing members are configured to be inserted in the holes of the connection system and to mechanically connect a striking head to the body in an orthogonal direction to the striking head.

16 Claims, 3 Drawing Sheets

HANDLE FOR A HAND-OPERATED STRIKING TOOL, HAND-OPERATED STRIKING TOOL AND METHOD FOR MANUFACTURING A HAND-OPERATED STRIKING TOOL

BACKGROUND OF THE INVENTION

The invention relates to a striking tool and to the corresponding manufacturing method.

STATE OF THE ART

Hand-operated striking tools, such as hammers, sledge hammers, clubs or chopping axes are conventionally provided with a handle and a striking head. When the user uses this kind of tool, he is subjected to the vibration of the handle at the moment the striking head impacts the struck object. Consequently, if the user uses striking tools in repetitive manner, he may be subject to musculo-skeletal problems such as the carpal tunnel syndrome or Guyon's cavity syndrome, or a loss of sensation at the fingertips such as the Raynaud syndrome.

Striking tools provided with handles designed to transmit vibrations of limited amplitude to the user exist on the market. For example, the Stanley company markets a hammer forged in a single part and having a handle which is coated with a material absorbing vibrations. This company also proposes a tuning-fork system placed at the end of the handle of the tool to concentrate the vibrations.

More recently the applicant developed a striking tool provided with a handle specially designed to reduce the vibrations transmitted to the user, in particular the vibrations of a hammer. This device is described in the document US 2012-0152066.

OBJECT OF THE INVENTION

One object of the invention is to provide a striking tool enabling the vibrations transmitted to the user to be significantly reduced.

For this, the handle comprises a body having a striking end corresponding to a terminal area.

The handle further comprises a connection system configured to surround the terminal area of the body at a distance so as to define a space between the connection system and the body. The connection system further comprises at least one access hole to the body on each front surface in the terminal area of the body.

The handle further comprises at least two securing members configured to be inserted in the holes of the connection system and to mechanically connect a striking head to the body.

In preferential manner, the securing members comprise a front surface of substantially complementary shape to that of the body. The members are furthermore preferably positioned on a vibration node of the handle when striking takes place.

According to one embodiment, the space situated between the body and the connection system defines a functional clearance. In an alternative manner, at least one shock-absorbing part can be configured to be placed in the space situated between the terminal area of the body and the connection system.

Having a functional clearance or a shock-absorbing part between the sheath and the connection system enables the vibrations to be isolated and prevents them from being transmitted to the handle and therefore to the user.

According to one embodiment, the securing system can comprise a casing configured to house the terminal area of the body. The securing system can also comprise a sleeve configured to be connected to the inner wall of the casing.

Furthermore, the body can advantageously comprise a core and a sheath surrounding the core. In this case, the sheath can comprise at least two holes placed facing the holes of the connection system, in which the securing members are designed to mechanically connect the core to the striking head.

The technical characteristics of the materials can be used alone or in combination:

- the core is made from composite material such as glass fibre, or carbon fibre impregnated with thermosetting resin,
- the sleeve and securing members are made from materials presenting a hardness comprised between 30 and 60 Rockwell C, and correspond for example to metals,
- the sheath and the casing are made from metals presenting a hardness comprised between 60 and 80 Shore D, such as for example plastics, in particular polypropylene,
- and the shock-absorbing part is made from a material having a hardness comprised between 0 and 50 Shore A.

According to one embodiment of the invention, the handle can also comprise a first additional sheath covering the sheath and having a hardness comprised between 55 and 80 Shore A, the first additional sheath itself being covered by a second additional sheath having a hardness comprised between 35 and 50 Shore A.

The invention also relates to hand-operated striking tools provided with a handle comprising one or more of the features that have just been mentioned above.

The fact that the core and the sheath are in contact in the gripping area of the tool advantageously enables transmission of vibrations comprised between 500 and 1000 Hz, which causes a loss of sensations at the fingertips, to be limited. Transmission of the vibrations is even more attenuated with the presence of a first and second additional sheaths.

The invention finally also relates to a method for manufacturing a hand-operated striking tool comprising on the one hand a handle comprising a body comprising a terminal area, and on the other hand a striking head comprising a pass-through hole opening out on two opposite surfaces, comprising an inlet of minimal cross-section and an inlet of maximal cross-section, the pass-through hole having a complementary shape to the striking end of the handle, a method characterized in that it comprises the following steps:

- inserting the terminal area of the body into the inlet of minimal cross-section of the hole of the striking head,
- making the terminal area of the body protrude beyond the maximal cross-section of the hole of the striking head,
- surrounding the terminal area of the body at a distance by a connection system so as to define a space between the connection system and the body, the connection system comprising at least one access hole to the body on each front surface of the terminal area of the body,
- inserting at least two securing members into the holes of the connection system, the securing members being configured to mechanically connect a striking head to the body,
- securing the connection system and the securing members in the hole of the striking head by sliding the handle towards the minimal cross-section of the hole of the striking head.

BRIEF DESCRIPTION OF THE DRAWINGS

Other advantages and features will become more clearly apparent from the following description of particular embodiments of the invention given for non-restrictive example purposes only and represented in the appended drawings, in which.

DETAILED DESCRIPTION

Figure 1:
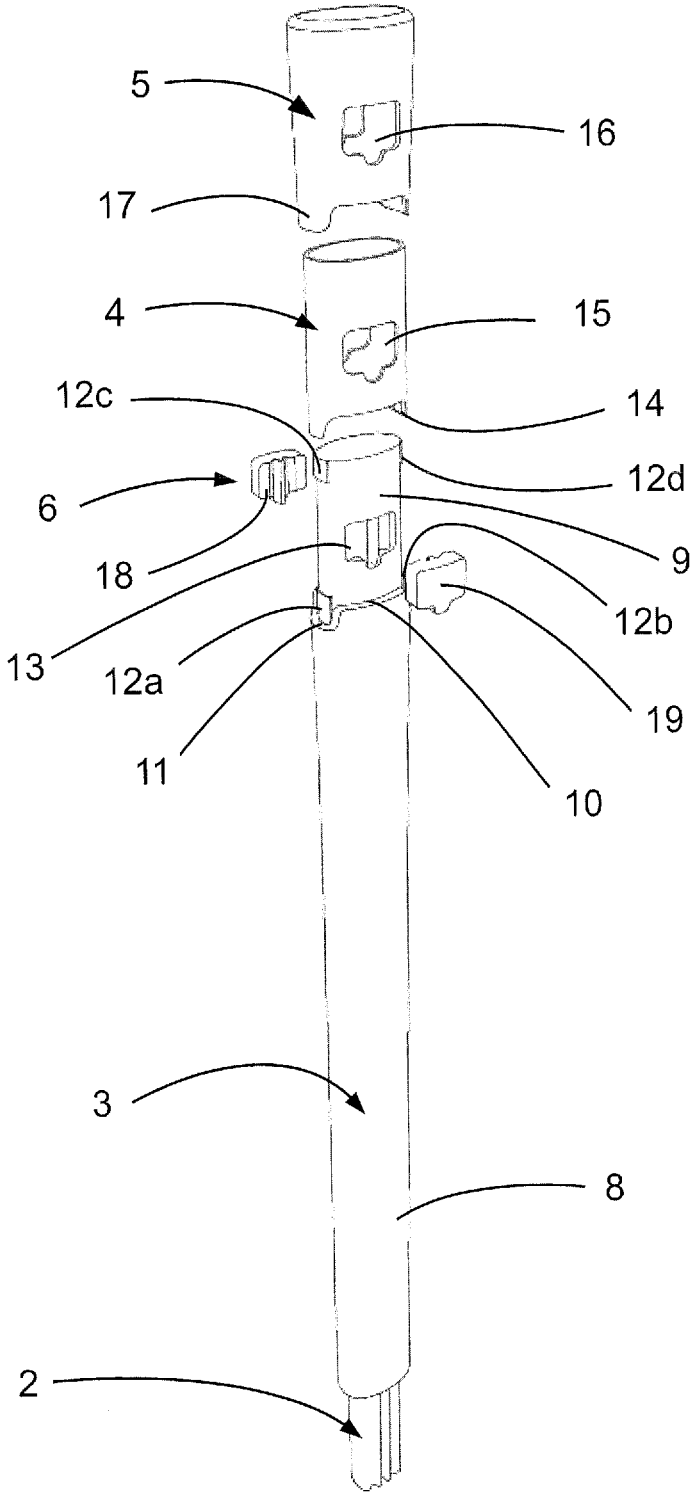
FIG. 1 illustrates in schematic manner an exploded perspective view of an embodiment of the handle of a hand-operated striking tool.

In FIG. 1, an exploded view of different parts present in a particular embodiment of a handle 1 of a striking tool has been represented. This handle 1 is formed here from: a body comprising a core 2 and a sheath 3, a connection system comprising a sleeve 4 and a casing 5, and two securing members 6. In an alternative embodiment, handle 1 could quite easily be made without sleeve 4. The body further comprises an end called "striking" end which corresponds to a terminal area 9 of the handle, as will be seen further on.

Figure 2:
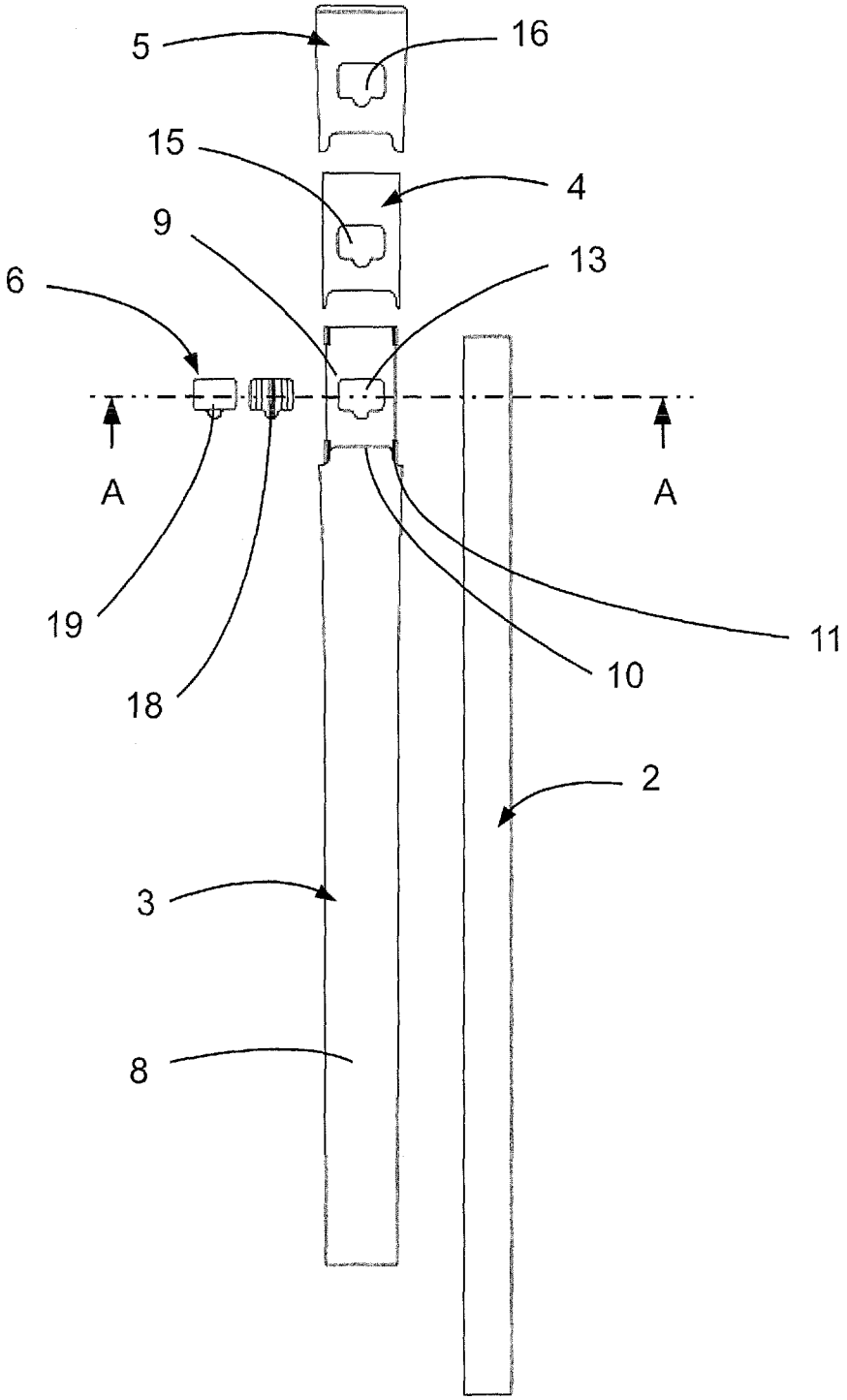
FIG. 2 represents an exploded front view of the handle according to the embodiment presented in FIG. 1, FIGS. 3 and 4 are cross-sectional views of the handle along a line A-A in two particular embodiments of the invention.

The front surfaces of the different parts are defined as being those of the type represented in FIG. 2, as opposed to the lateral surfaces which are only visible in FIG. 1.

It is apparent in FIGS. 1 and 2 that core 2 preferably extends over the whole length of handle 1. Unlike handles commonly used for striking tools, in a specific embodiment, the front surfaces of core 2 have a particular shape. Each front surface comprises three grooves 7*a*, 7*b*, and 7*c* (cf. FIGS. 3 and 4), which has the effect of limiting the vibrations of the handle when striking takes place. Advantageously, the grooves are symmetrical according to planes of symmetry passing through the middle of the front surfaces and/or the middle of the lateral surfaces.

Furthermore, core 2 is preferably made from a composite material, for example by pultrusion of glass or carbon fibres impregnated with thermosetting resin.

Here, core 2 and the cavity of sheath 3 have complementary shapes so that the sheath is in contact with the whole wall of core 2.

Sheath 3 is a part advantageously made from a material having a lower hardness range than that of the material of core 2. It may be a plastic material with a hardness comprised between 60 and 80 Shore D, for example polypropylene.

In the embodiment presented in FIGS. 1 and 2, sheath 3 advantageously has a frustum-shaped outer shape. Sheath 3 can have a different outer shape, for example the shape of a frustum of a pyramid. In a particular embodiment, sheath 3 has a first end having a minimal cross-section and a second end having a maximal cross-section, the cross-section of sheath 3 being continually increasing.

Preferably, sheath 3 at least partially covers core 2, and preferably covers the whole of core 2. It is also provided with a pass-through cavity on at least one surface so that core 2 can be inserted therein. The thickness of sheath 3 is further preferably situated in a range comprised between 1 mm and 5 mm.

In an embodiment that is not represented, sheath 3 can be covered by a first additional sheath, the latter also able to be covered by a second additional sheath. In this case, the first additional sheath has a hardness comprised between 50 and 80 Shore A, and the second additional sheath advantageously has a hardness comprised between 35 and 50 Shore A. The hardness of the materials of the traditional sheaths is chosen to attenuate the vibratory waves.

The thickness of sheath 3 and the fact of superposing several sheaths on one another present the advantage of limiting transmission of the vibrations of frequencies comprised between 500 and 1000 Hz which are responsible for loss of sensation at the fingertips. The contact between core 2 and sheath 3 also enables the vibrations to be reduced in this frequency range.

In a particular embodiment which can be combined with the embodiment described up to now, sheath 3 can present a terminal area 9 of smaller external diameter than the adjacent area of sheath 3 to form a rim 10. The latter can therefore be located at the junction between a gripping end 8 and terminal area 9 of sheath 3. Rim 10 is preferably configured to form two notches 11 arranged for example on lateral surfaces of sheath 3. Notches 11 are preferably diametrically opposite one another.

In a particular embodiment, the outer wall of terminal area 9 advantageously comprises prongs 12 on the lateral surfaces, for example four prongs in this embodiment. Here two prongs 2*b* are positioned in notches 11, and two other prongs 12*c* and 12*d* are located at the end of terminal area 9 in such a way that both prongs 12*a* and 12*c* and prongs 12*b* and 12*d* are above one another, i.e. aligned along the longitudinal axis of core 2.

Terminal area 9 of sheath 3 further comprises at least two holes 13 positioned on each front surface, each hole 13 being able to be configured to access core 2. In this way, holes are placed along an axis perpendicular to the striking axis when the user uses the tool.

In a particular embodiment presented in the figures, terminal area 9 of sheath 3 is covered by connection system comprising sleeve 4 and casing 5.

Here, sleeve 4 is preferably a part of constant cross-section so that a space exists between sleeve 4 and terminal area 9 of sheath 3. In this way, the sleeve surrounds the terminal area of sheath 3 at a distance.

According to an advantageous embodiment, the connection system is configured to surround terminal area 9 of the body at a distance so that a space exists between the connection system and the body.

In the embodiment illustrated in the figures, the distance separating sleeve 4 from terminal area 9 of sheath 3 measures a few millimeters, and is preferably smaller than 5 mm. Advantageously, prongs 12 are configured for the distance separating them from the wall of sleeve 4 to be about 1 mm. Sleeve 4 is thus free to move with respect to terminal area 9 of sheath 3, in particular in the striking direction and in the direction perpendicular to the striking direction.

Furthermore, one of the ends of sleeve 4 has a complementary shape to that of rim 10 of sheath 3. More precisely, the lateral surfaces of sleeve 4 are provided with salient portions 14 complementary to notches 11 of sheath 3.

In this way, the end of sleeve 4 snugly follows the shape of rim 10 of sheath 3, which limits the movement of sleeve 4 along the longitudinal axis of handle 1.

Figure 3:
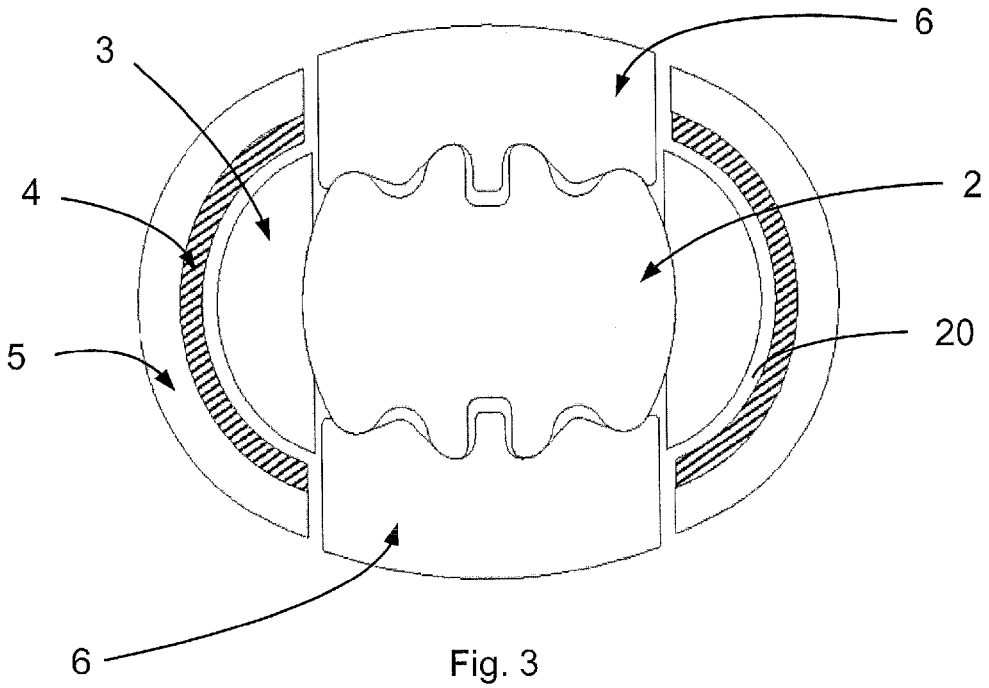
Figure 4:
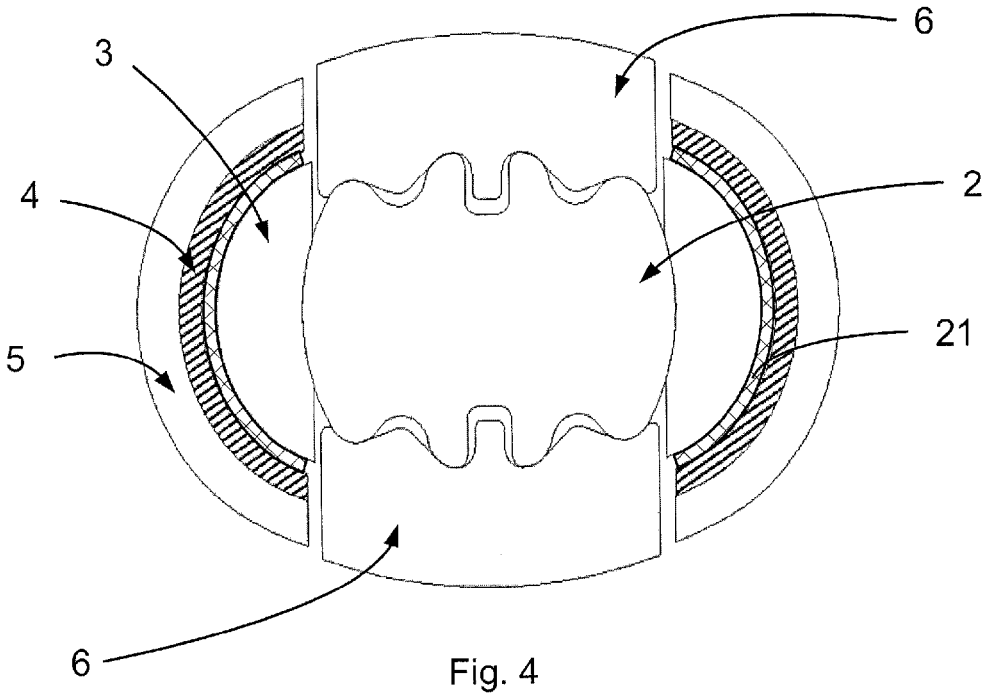

In the embodiment illustrated in FIG. 3, the space situated between sheath 3 and sleeve 4 remains empty. It corresponds to a functional clearance 20 enabling the vibrations to be dampened. According to an alternative embodiment illustrated in FIG. 4, the space can be filled by at least one shock-absorbing part 21, preferably two diametrically opposite shock-absorbing parts 21 situated on the lateral surfaces, whereas the front surfaces are left free to enable insertion of securing members 6. Shock-absorbing parts 21 are advantageously made from a soft material having a hardness comprised between 30 and 50 Shore A. This corresponds for example to the hardness of an elastomer.

Whether the space between sheath 3 and sleeve 4 corresponds to a functional clearance 20 or whether it is filled by one or more shock-absorbing parts 21, this enables the vibrations transmitted from core 2 to sheath 3, and therefore to the user, to be greatly attenuated. Sleeve 4 is fitted mobile with respect to handle 1 in the striking direction so that the striking energy is provided to the striking head mainly during the impact.

Sleeve 4 is also provided with at least two holes 15, one on each front surface. Holes 15 are located facing holes 13 of terminal area 9 of sheath 3 so that each hole 15 is associated with a hole 13 in order to secure securing members 6 therein.

In more general manner, the connection system comprises at least one access hole to the body on each front surface in the terminal area of the body.

Sleeve 4 is advantageously made from a material such as a metal having a hardness range comprised between 30 and 60 Rockwell C. Covering terminal area 9 of sheath 3 by sleeve 4 enables the resistance to the striking force of the striking tool to be increased. The hardness range of the material of sleeve 4 is furthermore judiciously chosen so that the resistance to the striking force of a handle 1 provided with a sleeve 4 is higher than that of a handle 1 not having a sleeve 4.

Finally, sleeve 4 is advantageously covered by casing 5, the latter being hollow to in particular be able to insert sleeve 4 therein. The inner wall of casing 5 preferably has a constant cross-section and a similar shape to that of sleeve 4, so that casing 5 and sleeve 4 are in continuous radial contact over the whole perimeter of sleeve 4.

Sleeve 4 and casing 5 can advantageously form part of a connection system positioned on handle 1, and on which the striking head is placed. However, the connection system can be operational without sleeve 4. The longer handle 1, the more advantageous the addition of sleeve 4 in the connection system. Indeed, with a longer handle 1, the striking force can be higher, which can have the effect of the making the striking head come adrift if the connection system is not sufficiently rigid.

A hammer can therefore be manufactured using for example a handle 1 the connection system of which is provided with a single casing 5. A sledge hammer is on the other hand advantageously provided with a handle 1 the connection system of which comprises both a casing 5 and a sleeve 4.

The outer wall of casing 5 has a similar shape to that of sheath 3, and in the embodiment illustrated in the figures, its cross-section is continually increasing. More precisely, casing 5 is frustum-shaped and the edge of casing 5 has a complementary shape to that of rim 10. It can also comprise a salient portion 17 on each lateral surface.

The thickness of rim 10 is advantageously adjusted to be substantially identical to the sum of the thickness of sleeve 4 and of casing 5. Thus, when sleeve 4 and casing 5 are positioned on sheath 3, the outer wall of handle 1 is substantially smooth, which makes cleaning easier and limit the risks of injury.

Casing 5 comprises at least two holes 16 located on each front surface, holes 16 being situated facing holes 15 and holes 13 to be able to insert securing members 6.

As far as the composition of casing 5 is concerned, the latter is advantageously made from a soft material having a hardness range comprised for example between 60 and 80 Shore D. In the same way as sheath 3, this can be a plastic material such as polypropylene. The hardness range chosen for manufacturing casing 5 both enables casing 5 to be forcibly engaged in a striking head and a part of the vibrations transmitted by the striking head to handle 1 to be absorbed.

According to one embodiment, securing members 6 are advantageously configured to be inserted in holes 15 and 16 of the connection system to mechanically connect a striking head (not shown) to the body, in an orthogonal direction to the striking axis.

Here, securing members 6 are inserted in holes 13, 15, and 16 and are configured to mechanically connect the striking head to core 2 to limit the vibrations of handle 1 when striking. A part of securing members 6 is salient outside handle 1, this part being in contact with the striking head.

The portion of securing members 6 which is salient outside handle 1 is advantageously larger than the distance separating sheath 3 from sleeve 4.

In this way, securing members 6 prevent sleeve 4 and sheath 3 from coming apart.

Furthermore, securing members 6 comprise front surfaces 18 and 19 able to present a particular shape. Surfaces 18 in contact with core 2 advantageously have a complementary shape to that of the front surfaces of core 2, and front surfaces 19 salient outside handle 1 for their part have a complementary shape to the cavities situated in the striking head, as will be seen further on. In a preferred embodiment, the thickness of securing members 6 is equal to the distance separating the front surfaces of core 2 from the bottom of the cavity of the striking head. In this way, no clearance exists between the striking head and core 2, which enables efficient transmission of the vibrations to be limited.

Securing members 6 are advantageously positioned on the front surfaces of handle 1, i.e. on an axis orthogonal to the striking axis. Placing securing members 6 orthogonally to the striking axis limits transmission of vibrations.

Securing members 6 are further advantageously placed in an area corresponding to a vibration node of handle 1. By connecting the striking head to core 2 in this area, this gives rise to breaking of the vibration bridge, which means that when the user uses the striking tool, the vibrations are hardly transmitted to sheath 3 and therefore to the user. This is particularly true for vibrations having a frequency of less than 500 Hz and which are at the origin of wrist and elbow ailments.

Securing members 6 are advantageously made from a material such as a metal, and their hardness is for example comprised in a range ranging from 30 to 60 Rockwell C.

To be able to house a part of handle 1 in the striking head, the latter comprises a pass-through hole opening out on two opposite surfaces, preferably on the bottom and top surfaces of the striking head, as opposed to its front and lateral surfaces. The hole of the striking head advantageously has a complementary shape to that of handle 1, and has a slightly smaller cross-section so that handle 1 is forcibly engaged in the striking head. In preferential manner, the pass-through hole comprises an inlet of minimal cross-section and an inlet of maximal cross-section.

The parts of securing members 6 salient outside handle 1 are then positioned pressing inside the hole of the striking head. The advantageously frustum shapes of the handle 1 and of the hole of the striking head enable securing members 6 to be compressed on the core when handle 1 is moved inside the striking head towards the end of smaller cross-section of the hole.

Securing members 6 therefore in particular have the function of preventing the striking head and handle 1 from coming apart.

When manufacturing of the hand-operated striking tool is performed, the different parts which compose handle 1 have to be assembled. Sheath 3 can advantageously be over-moulded around the core by injection of polypropylene. In this way, core 2 and sheath 3 are in contact and form the body of handle 1.

According to the embodiments, one or two additional sheaths can be placed around sheath 3. It is also possible to surround terminal area 9 of sheath 3 by one or more shock-absorbing parts.

To manufacture the tool, the body of handle 1 is first of all inserted in the striking head. For this, terminal area 9 is inserted on the side where the hole of the striking head has a minimal cross-section. For this, rim 10 of the sheath is configured to have a smaller cross-section than the inlet of minimal cross-section of the hole of the striking head.

Terminal area 9 is then moved to the other end of the striking head, i.e. the side where the inlet has a maximal cross-section.

Casing 5 is further pre-positioned above sleeve 4. The connection system comprising sleeve 4 and casing 5 is then positioned on terminal area 9 of sheath 3 so that the connection system is up against the stop formed by rim 10 of sheath 3.

Depending on the chosen embodiment, a functional clearance can exist between terminal area 9 of sheath 3 and sleeve 4. This space can also be filled by the shock-absorbing part or parts.

At this stage, securing members 6 are inserted in holes 13, 15 and 16 of sheath 3, of sleeve 4 and of casing 5 respectively, until they are in contact with core 2.

Handle 1 is then pushed into hole of the striking head in the direction of the inlet of smallest cross-section until sleeve 4 and casing 5 are flush-mounted in the hole of the striking head, and securing members 6 are jammed between core 2 and the hole of the striking head. This operation can in particular be performed with the help of a press.

The striking end of handle 1 preferably having a larger cross-section than the cross-section of the hole of the striking head, this results in handle 1 being held forcibly in the striking head. This enables a solid assembly of the two parts to be achieved, and prevents any nuisance disassembly.

An efficient striking tool is thus provided that is simple to manufacture, and is particularly suitable for users using this kind of tool in repetitive manner.

The invention claimed is:

1. A handle for a hand-operated striking tool comprising:

a body having a striking end corresponding to a terminal area, a connection system configured to surround the terminal area of the body at a distance so as to define a space between the connection system and body, the connection system comprising at least one access hole to the body on each front surface in the terminal area of the body, at least two securing members, configured to be inserted in the holes of the connection system, and to mechanically connect a striking head to the body in an orthogonal direction to the striking axis.

2. The handle for a hand-operated striking tool according to claim 1, wherein the space situated between the body and the connection system defines a functional clearance.

3. The handle for a hand-operated striking tool according to claim 1, comprising at least one shock-absorbing part configured to be placed in the space situated between the terminal area of the body and the connection system.

4. The handle for a hand-operated striking tool according to claim 3, wherein the material of the shock-absorbing part has a hardness comprised between 0 and 50 Shore A.

5. The handle for a hand-operated striking tool according to claim 1, wherein the securing members comprise a front surface of substantially complementary shape to that of the body.

6. The handle for a hand-operated striking tool according to claim 1, wherein the securing members are positioned on a vibration node of the handle when striking takes place.

7. The handle for a hand-operated striking tool according to claim 1, wherein the connection system comprises a casing configured to house the terminal area of the body.

8. The handle for a hand-operated striking tool according to claim 7, wherein the connection system further comprises a sleeve of greater hardness than the hardness of the casing, and configured to be connected to the inner wall of the casing.

9. The handle for a hand-operated striking tool according to claim 8, wherein the material of the sleeve presents a hardness comprised between 30 and 60 Rockwell C.

10. The handle for a hand-operated striking tool according to claim 7, wherein the material of the casing presents a hardness comprised between 60 and 80 Shore D.

11. The handle for a hand-operated striking tool according to claim 1, wherein the body comprises a core and a sheath surrounding the core.

12. The handle for a hand-operated striking tool according to claim 11, wherein the sheath comprises at least two holes placed facing the holes of the connection system, and wherein the securing members are designed to mechanically connect the core to the striking head.

13. The handle for a hand-operated striking tool according to claim 11, wherein the core is made from a thermosetting or thermoplastic composite material.

14. The handle for a hand-operated striking tool according to claim 11, wherein the material of the sheath presents a hardness comprised between 60 and 80 Shore D.

15. The handle for a hand-operated striking tool according to claim 1, wherein the material of the securing members presents a hardness comprised between 30 and 60 Rockwell C.

16. A method for manufacturing a hand-operated striking tool comprising on the one hand a handle comprising a body comprising a terminal area, and on the other hand a striking head comprising a pass-through hole opening out on two opposite surfaces, comprising an inlet of minimal cross-section and an inlet of maximal cross-section, the pass-through hole having a complementary shape to the striking end of the handle, a method comprising the following steps:

inserting the terminal area of the body into the inlet of minimal cross-section of the hole of the striking head, making the terminal area of the body protrude beyond the maximal cross-section of the hole of the striking head, surrounding the terminal area of the body at a distance by a connection system so as to define a space between the connection system and the body, the connection system comprising at least one access hole to the body on each front surface in a terminal area of the body, inserting at least two securing members into the holes of the connection system, the securing members being configured to mechanically connect a striking head to the body, securing the connection system and the securing members in the hole of the striking head by sliding the handle towards the minimal cross-section of the hole of the striking head.

* * * * *